US005392703A

United States Patent [19]

Makarchuk et al.

[11] Patent Number: 5,392,703

[45] Date of Patent: * Feb. 28, 1995

[54] TAPE FEEDING, CUTTING AND EJECTING APPARATUS FOR A MAILING MACHINE

[75] Inventors: Irena Makarchuk, Fairfield; John R. Nobile, both of Fairfield; William A. Salancy, Norwalk, all of Conn.

[73] Assignee: Pitney Bowes Inc., Stamford, Conn.

[ * ] Notice: The portion of the term of this patent subsequent to Feb. 21, 2012 has been disclaimed.

[21] Appl. No.: 180,161

[22] Filed: Jan. 11, 1994

[51] Int. Cl.[6] ..... B41L 47/46

[52] U.S. Cl. ..... 101/92; 400/621; 400/613; 101/227; 346/136; 235/101

[58] Field of Search ..... 400/613, 613.1, 614, 400/617, 621; 101/91, 92, 93, 226, 227, 228; 226/11, 91, 92, 143; 235/101; 177/4, 145; 83/203, 509, 200; 364/464.1; 346/134, 136

[56] References Cited

U.S. PATENT DOCUMENTS

| | | | |
|---|---|---|---|
| 2,273,295 | 2/1942 | Strother et al. | 101/235 |
| 3,556,001 | 1/1971 | Kinney | 101/92 |
| 3,583,314 | 6/1971 | Gillender | 235/101 X |
| 3,749,013 | 7/1973 | Ellner | 101/277 |
| 3,791,293 | 2/1974 | Rostorguef et al. | 101/234 |
| 4,412,466 | 4/1983 | Jurkowstry | 83/200 |
| 4,580,144 | 4/1986 | Calvi | 235/101 X |
| 4,922,085 | 5/1990 | Dannett et al. | 235/101 |
| 4,957,179 | 9/1990 | Dannett | 101/91 X |
| 5,171,975 | 12/1992 | Lyga | 101/91 X |

*Primary Examiner*—Edgar S. Burr
*Assistant Examiner*—Christopher A. Bennett
*Attorney, Agent, or Firm*—Melvin J. Scolnick; David E. Pitcheink; Steven J. Shapiro

[57] ABSTRACT

An apparatus is disclosed which is a tape feeding, cutting and ejecting apparatus for a mailing machine which has a feed deck for envelopees and a postage meter for printing postage indicia on successive envelopees as they are fed along the feed deck. The tape feeding, cutting and ejecting apparatus is mounted in the mailing machine above the feed deck and adjacent to the postage meter on the side thereof opposite to the direction of the feed of envelopees for feeding successive finite lengths of tape to the postage meter for printing of postage indicia on a portion thereof and for cutting and ejecting the printed portion of the finite lengths of tape from the mailing machine. The apparatus includes separate drive mechanism for feeding the tape toward the postage meter and for ejecting the severed portion of the tape from the mailing machine, and the drive mechanism for the latter functions also controls the operation of a rotary knife for severing the tape in timed relationship to the feed of the printed tape away from the postage meter.

16 Claims, 12 Drawing Sheets

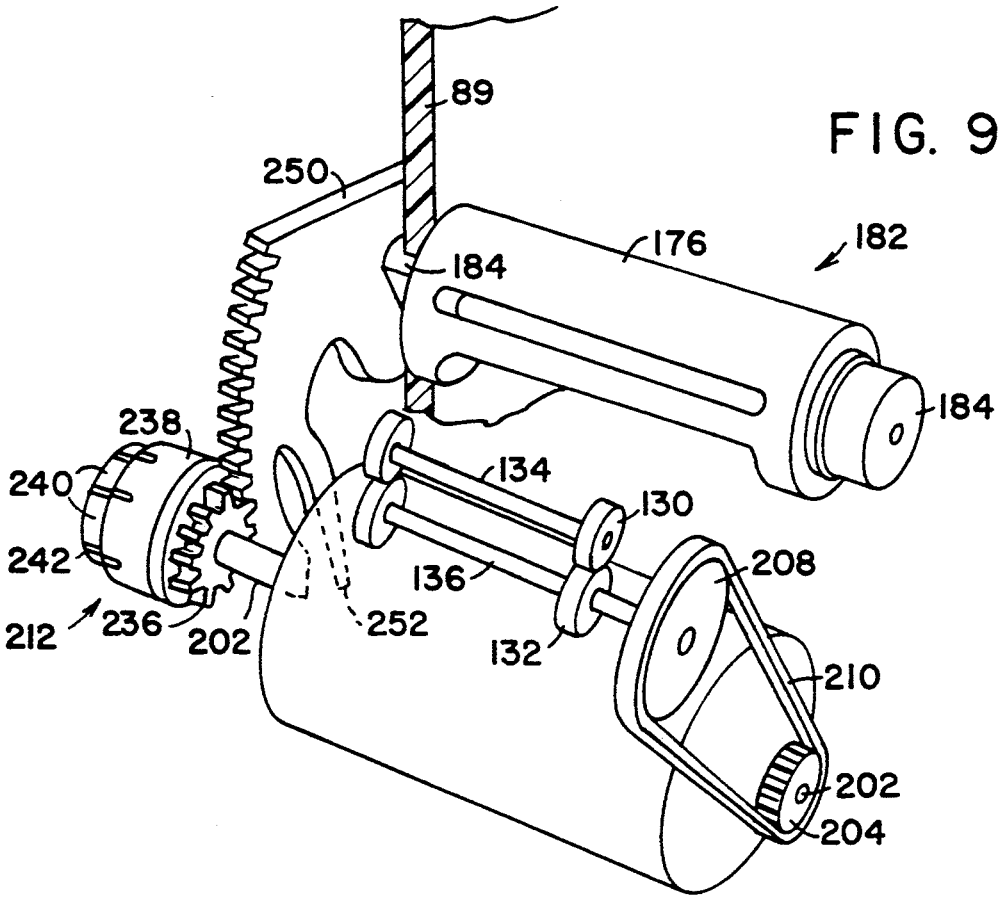
FIG. 9
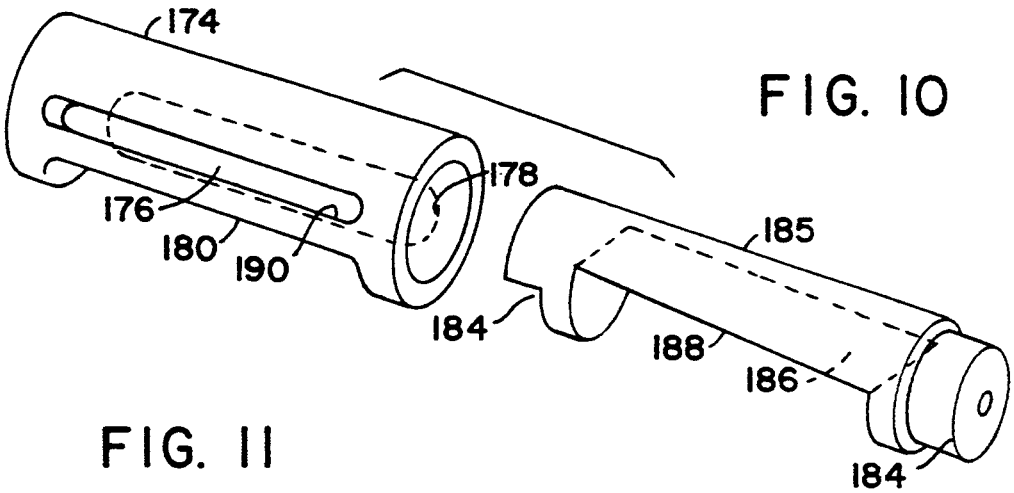
FIG. 10
FIG. 11
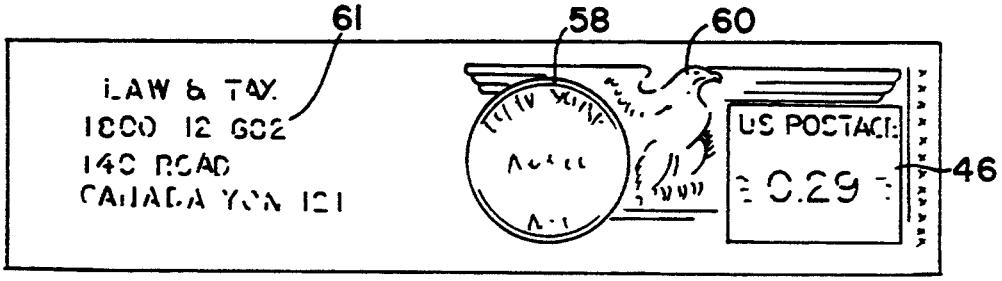

FIG. 15
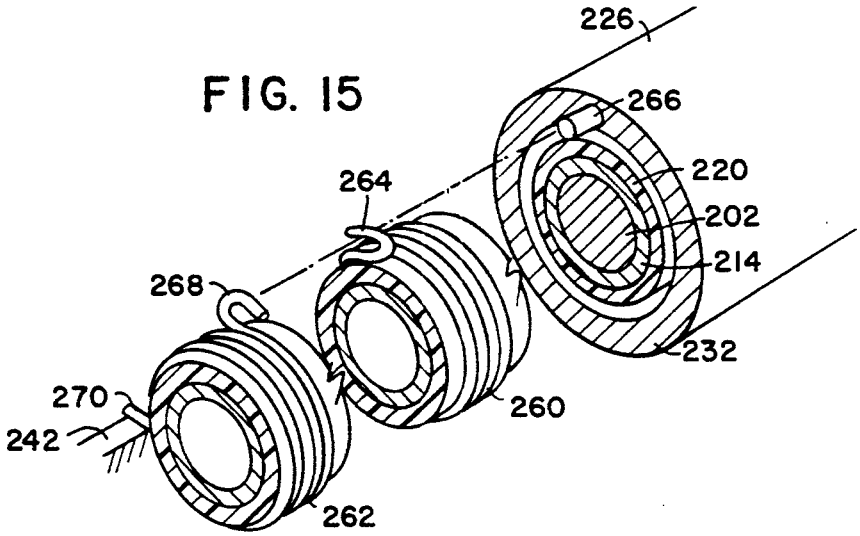
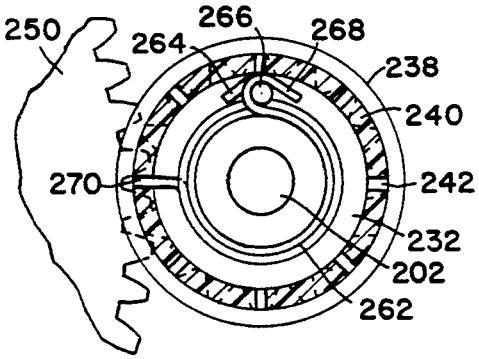
FIG. 16
FIG. 17
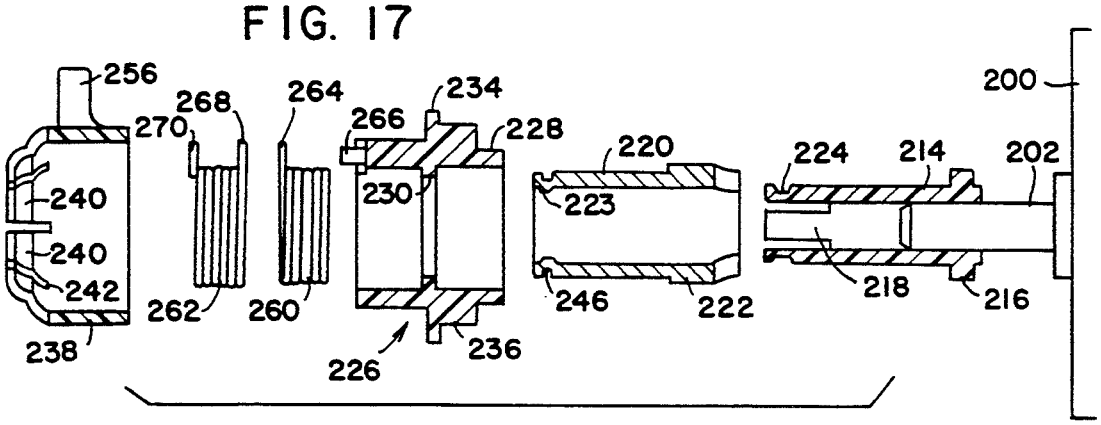

TAPE FEEDING, CUTTING AND EJECTING APPARATUS FOR A MAILING MACHINE

BACKGROUND OF THE INVENTION

The present invention relates generally to mailing machines having a postage meter which prints postage indicia on envelopees as they are fed sequentially along a feed path extending through the mailing machine, and more particularly to a tape feeding, cutting and ejecting apparatus for such mailing machines which enables the postage meter to print the postage indicia on the tape.

The present invention is an improvement on the tape feeding, cutting and ejecting apparatus disclosed and claimed in copending U.S. patent application Ser. No. 08/180,163, filed on Jan. 11, 1994, in the names of Morton Silverberg, William A. Salancy and Steven A. Supron, and assigned to the assignee of this application.

A detailed discussion of the advantages of incorporating the capability of printing postage indicia on tape, as well as the problems and difficulties encountered with the tape feeding, cutting and ejecting mechanisms of prior art mailing machines, is set forth in the five paragraphs following the first paragraph of the above mentioned copending application, which discussion is incorporated herein by reference. Further, certain advantageous features of the tape feeding, cutting and ejecting mechanism disclosed and claimed in the above mentioned copending application are discussed in the next paragraph following the five just mentioned, and that discussion is likewise incorporated herein by reference since those advantageous features are applicable to the corresponding improved apparatus disclosed and claimed in this application.

Although the tape feeding, cutting and ejecting mechanism disclosed and claimed in the above mentioned copending application worked in principle, it became apparent after building and operating that mechanism that it had a number of functional problems which would have a substantial adverse impact on the marketability of mailing machines incorporating that mechanism. One major problem resulted from utilizing the postage meter printing mechanism to pull the tape from the tape supply roll through the guide members of the first feed path as well as the feeding means, after the leading edge of the tape was gripped between the printing die and the impression roller of the printing mechanism. The problem was that it required a large force between the printing die and the impression roller to literally pull the tape through the necessary length of travel and the associated parts without the tape slipping in the printing mechanism and causing a smudged or blurred, and hence unacceptable, postage indicia. The ink used in postage meter printing devices is an effective lubricant, thereby facilitating slippage between the tape and the printing die if substantial drag is imposed on the tape in the absence of high pressing force between the printing die and the impression roller. In order to achieve the necessary pressing force to prevent the tape slippage and obtain tapes having acceptable print quality, it was necessary to utilize a heavy motor to drive the print drum of the postage meter on which the printing die is mounted, which increased the power consumption and operating noise of the postage meter compared to those utilizing prior art tape feeding, cutting and ejecting mechanisms.

Another major problem of the prior mechanism resulted from the design of the cutting device, which employed a stationary anvil or cutting blade against which a movable blade moved to cut the tape laterally in a manner similar to a scissors. Even though the anvil remained stationary during a cutting operation, it was, nevertheless, mounted for limited movement toward the movable blade and held against the movable blade by a heavy spring, in order to provide the contact pressure between the two blades necessary to cut the tape evenly and smoothly and also to compensate for wear on the blade surfaces, a slight amount of which could cause erratic cutting and jamming in the cutting mechanism. Thus, it required a large solenoid to activate the movable blade against the anvil, which required a heavy power consumption and made a considerable amount of objectionable noise. Also, the knife assembly did not have a long life due to the wear and tear on the knife blade from the high spring load.

Another problem of the prior apparatus was that provision had been made for driving the tape roll in a reverse or winding direction to rewind excess tape which had to be fed from the tape roll in order to bring a forward portion of the tape into the printing mechanism of the postage meter. Driving the tape roll in the reverse direction added some substantially complex structure which increased the cost of manufacture of the apparatus, the cost of operation in terms of higher power consumption and the possibility of malfunction and consequent need for service.

BRIEF DESCRIPTION OF THE INVENTION

The present invention addresses these shortcomings and disadvantages of the prior tape feeding, cutting and ejecting apparatus, and provides solutions which at least obviate if not altogether eliminate these problems. For example, to solve the problem of high impression roller force in the postage meter printing device to prevent tape slippage between the tape and the printing die, the present invention does not utilize the grip on the tape of the printing die and the impression roller to pull the tape through the feed path, but rather includes a means for positively feeding the tape until the printing operation is completed and the tape is ready to be retracted. By so doing, the pressing force of the impression roller is considerably reduced, resulting in use of a smaller, quieter and more efficient motor to drive the printing drum of the postage meter.

The problems inherent in the prior knife design were effectively solved by utilizing a rotary knife concept in which a semi-cylindrical knife element rotates through a predetermined arc within a cylinder having a pair of slots through which the tape passes. Since the fit of the movable knife element within the tube can easily be manufactured to a very close tolerance, much like a shaft in a bearing, it is possible to oscillate the movable knife element with far less power than was required with the former arrangement. Thus, the high power consuming and noisy solenoid could be replaced with a small, efficient and virtually noiseless motor, thereby reducing the cost of manufacture and operation of the device, and making it more attractive for use. Also, the new knife far outlasts the older concept by eliminating the high spring load on the blades, Also, it is far more space effective than the prior design, a feature which is critical in a machine where a large amount of complex structure must be made to fit into the smallest possible package.

Another problem inherent in the prior apparatus that has been eliminated from the present invention is that of the necessity for driving the tape roll in a reverse direction to take up the slack when the tape is moved in a reverse direction after printing of the postage indicia is completed. This is accomplished by providing certain guide plates as hereinafter described to force the excess tape to return to the supply roll and form a few loose turns around the supply roll while the tape is moving in the reverse direction. Also, several guide rollers are positioned around the tape supply roll to guide the tape in forming the loose turns, thereby eliminating the need for the structure otherwise required to drive the tape roll in a reverse direction.

These and other advantages and features of the present invention are achieved by providing an apparatus as hereinafter disclosed and claimed, but which in its broader aspects, is incorporated in a mailing machine which has an elongate feed deck, means for feeding envelopees along the feed deck, a postage meter mounted in the mailing machine and having a printing mechanism disposed in juxtaposition with the feed deck so as to print a postage indicia on successive envelopees as they are fed along the feed deck. In this environment, the invention is a tape feeding, cutting and ejecting apparatus mounted in the mailing machine above the feed deck and adjacent to the postage meter on the side thereof opposite to the direction of feed of envelopees along the feed deck for feeding successive uncut finite lengths of tape from the roll of tape to the post meter for printing of postage indicia on a portion thereof and for cutting and ejecting the printed portion of the finite lengths of tape from the mailing machine.

The apparatus comprises means for holding a supply roll of tape of indefinite length adjacent the end of the apparatus that is proximate to the postage meter of the mailing machine, first guide means defining a generally U-shaped first feed path which extends generally from beneath the tape supply roll toward the end of the apparatus which is opposite to the end thereof proximate to the postage meter and then in the opposite direction toward the end proximate to the postage meter, the first feed path terminating closely adjacent to the printing mechanism of the postage meter, and second guide means defining a generally straight second feed path which extends from a point on the first feed path away therefrom in a direction generally opposite to that in which the first feed path extends toward the end of the apparatus proximate to the postage meter. The apparatus further includes a tape feeding means for feeding a finite length of tape from the tape supply roll in a forward direction along the first feed path to feed a portion of the finite length of tape through the printing mechanism of the postage meter for printing of a postage indicia on the portion of the finite length of tape, and means for reversing the direction of the tape feeding means to feed the tape in a reverse direction along the first feed path after the printing operation is complete. A severing means is disposed in the first feed path at the location where the second feed path commences for severing the tape when the trailing edge of the printed portion of the finite length of tape reaches the severing means, and for deflecting the leading edge of the severed portion into the second feed path. Finally, there is means for ejecting the severed printed portion of tape from the mailing machine along the second feed path.

In some of its more limited aspects, the invention includes a plurality of narrowly spaced apart guide plates and guide members which cooperate to define the first and second predetermined guide paths in the manner specifically hereinafter defined, and a tape feeding means disposed in the first feed path to feed tape both toward the postage meter prior to printing of the postage indicia and in the reverse direction away from the postage meter after printing. A severing means in the form or a rotary cutter is located at the juncture of the first and second feed paths so as to function as a combined tape cutting and deflecting mechanism.

A tape ejecting means is located in the second feed path for moving the tape in a reverse direction through the second feed path, which operates in conjunction with the tape feeding means during an initial portion of the reverse movement of the tape in both feed paths. Further, the drive mechanism for the second tape feeding means functions to operate the severing mechanism in timed relationship with the operation of the second tape feeding means.

Having briefly described the general nature of the present invention, it is a principal object thereof to provide a tape feeding, cutting and ejecting apparatus for a mailing machine which permits the mailing machine to print postage indicia either on envelopees or on tape for manual application to envelopees or packages.

It is another object of the present invention to provide a tape feeding, cutting and ejecting apparatus for a mailing machine which quickly and accurately feeds an uncut finite length of tape from the tape supply roll to the postage meter component of the mailing machine for printing of the postage indicia on a portion of the finite length, and then quickly withdraws the tape and severs the printed portion thereof for instant ejection from the mailing machine.

It is still another object of the present invention to provide a tape feeding, cutting and ejecting apparatus for a mailing machine which is designed to be a compact, modular unit that is easily installed in the mailing machine, is located entirely above the normal feed deck of the mailing machine and which can be easily loaded and threaded when tape replacement is necessary.

These and other objects and advantages of the present invention will become more apparent from an understanding of the following detailed description of a presently preferred embodiment of the invention, when considered in conjunction with the accompanying drawings.

BRIEF DESCRIPTION OF THE FIGURES OF THE DRAWINGS

FIG. 9 is a perspective view of the rotary knife, the eject feed rollers and the drive mechanism which operates both the knife and the feed rollers.

FIG. 10 is an exploded view of the components of the rotary knife.

FIG. 11 is as illustration of a representative postage indicia printed by the postage meter of the mailing machine.

FIG. 15 is an exploded perspective view of the wrap spring clutch assembly of the clutching mechanism shown in FIG. 12.

FIG. 16 is a sectional view of the clutching mechanism taken on the line 16—16 of FIG. 12.

FIG. 17 is a longitudinally exploded view of the clutching mechanism shown 126.

DETAILED DESCRIPTION OF THE INVENTION

Figure 1:
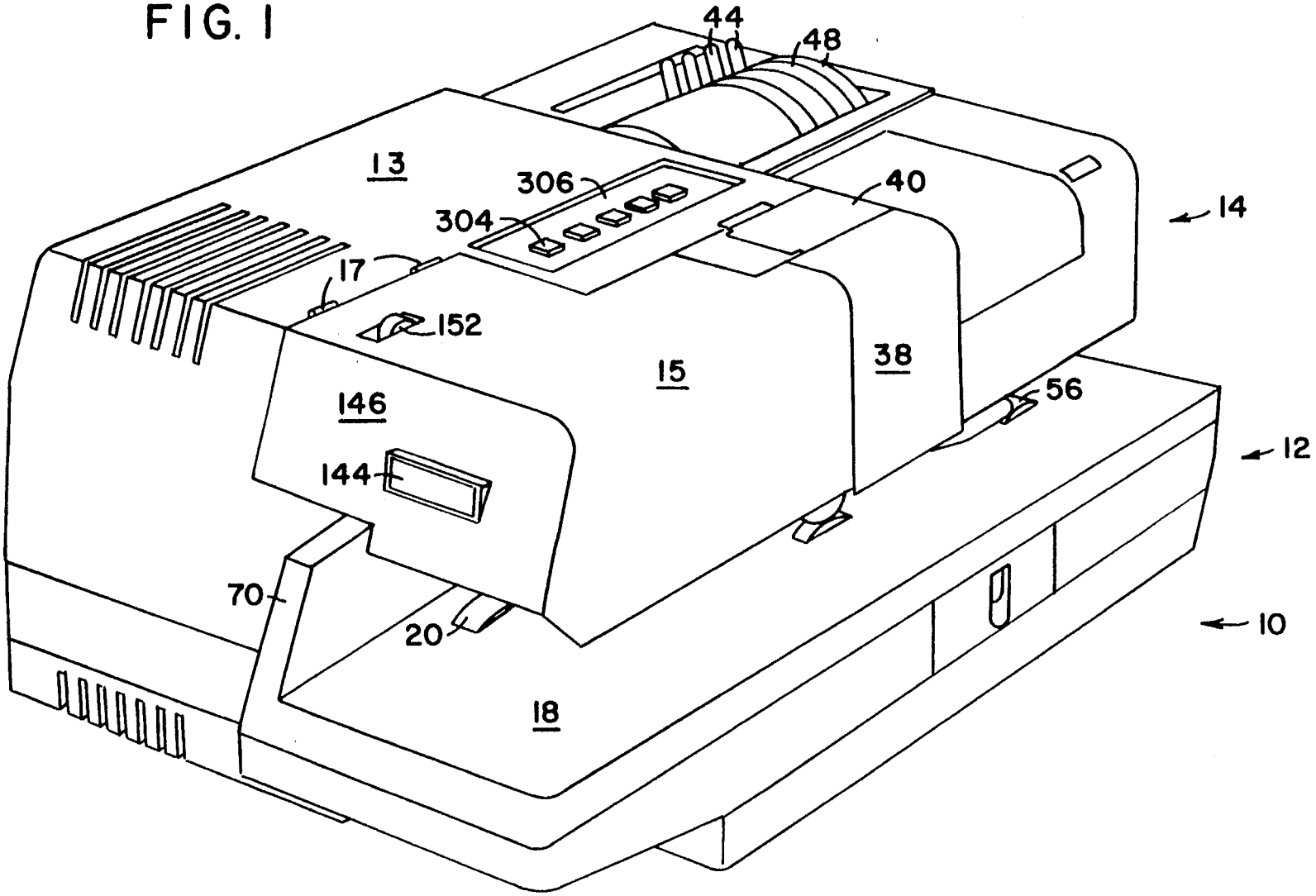
FIG. 1 is a partial front perspective view of a mailing machine which incorporate the tape feeding, cutting and ejecting apparatus of the present invention.
Figure 2:
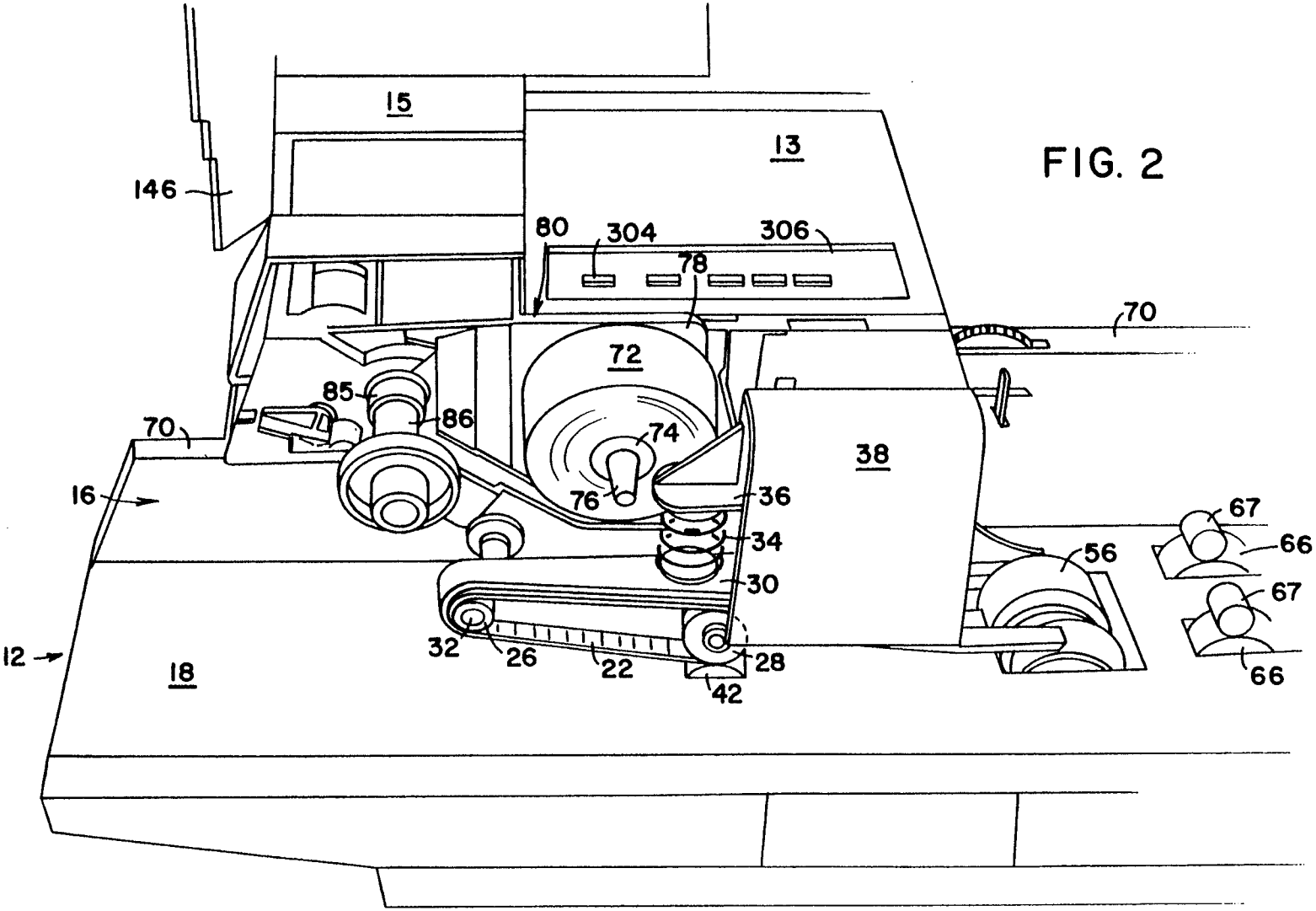
FIG. 2 is a front perspective view of the mailing machine shown in FIG. 1 with the outer housing of the mailing machine removed to expose the tape, feeding and cutting apparatus of the invention, and also with the postage meter removed to reveal certain detail.

Referring now to the drawings and particularly to FIGS. 1 and 2 thereof, there is seen a mailing machine designated generally by the reference numeral 10, of the type described in the aforementioned copending application which would be considered a mid-range sized mailing machine having the capability of printing postage indicia either on envelopees passing through the mailing machine or on gummed or adhesive backed tape for manual affixation to an envelopee. The mailing machine 10 includes a base designated generally by the reference numeral 12, a postage meter designated generally by the reference numeral 14, and a tape feeding, cutting and ejecting apparatus designated generally by the reference numeral 16 (FIG. 2). The mailing machine also includes a housing 13 having a cover 15 pivotally connected thereto as by the hinges 17 to permit the cover 15 to be raised to the position shown in FIG. 2 to provide access to the tape feeding, cutting and ejecting apparatus 16. It should be understood that, although mailing machines in general are highly complex in mechanical construction, the following description is simplified in the interest of brevity to include only so much structure of the mailing machine 10 as is necessary for an understanding of the present invention.

The base 12 includes a generally rectangular flat feed deck 18 which extends through the mailing machine 10 from one end to the other and serves to support envelopees and other mail pieces as they are fed through the mailing machine 10 in a left to right direction as the mailing machine is viewed in FIG. 1. The base 12 also includes feeding means such as one or more feed rollers 20 which project slightly above the surface of the feed deck 18 through suitable openings therein to engage the underside of envelopees as they move along the feed deck 18. The envelopees are fed to the postage meter 14 by a belt 22 which extends around a drive pulley 26 and an idler pulley 28 and which engages the upper surface of the envelopees. The outer surface of the belt 22 passing around the idler pulley 28 is mounted on an elongate housing 30 which is pivoted about the shaft 32 which drives the drive pulley 26, and the housing 30 is spring loaded downwardly by the spring 34 captured between the upper surface of the elongate housing 30 and a suitable bracket 36 formed on a portion of an ink cartridge housing 38 which covers a removable ink cartridge holder 40. The belt 22, as it passes around the idler pulley 28, engages an idler roller 42 mounted beneath the feed deck 18 which acts as a pressure backup to the idler pulley 28 to ensure proper feeding of the envelopees between the belt 22 and the idler roller 42. It should be noted at this time that the ink cartridge housing 38 includes a curved wall portion 41 adjacent to the outer peripheral surface of a tape roll described below, the purpose of which is fully explained hereinafter in connection with the description of operation of the apparatus 16.

The postage meter 14 is suitably mounted on the base 12 adjacent to the downstream end of the feed deck 18 and is suitably latched in place. With reference to FIGS. 1, 2, 5 and 6, the postage meter includes a plurality of setting levers 44 by which the amount of postage, seen as $0.29 in the postage rectangle 46 in the postage indicia shown in FIG. 11, is changed as needed, the levers 44 lining up with numerical indicia on the sliding scales 48. The postage meter 14 also includes a printing drum 50 mounted on a shaft 52 which is suitably driven to rotate in a counterclockwise direction as viewed in FIG. 5. The printing drum 50 carries a printing die 54 which has the image of the postage indicia embossed thereon. The base 12 includes a plurality of impression rollers 56 which engage the underside of envelopees passing thereover to press the envelopees into firm engagement with the printing die 54 so as to cause ink on the printing die 54 to be transferred to the upper surface of the envelopee. FIG. 11 shows a representative postage indicia which is printed from the die 54, including the aforementioned postage rectangle 46, the city, state and date circle 58, the eagle graphics 60 and an advertising slogan 61. The postage meter 14 also includes an inking device consisting of an ink cartridge 40 rotatably mounted in the aforementioned ink cartridge housing 38 which contacts a spring loaded transfer roller 64 for transferring ink from the cartridge 40 to the image surface of the printing die 54 each time the printing drum 50 makes a revolution.

The base 12 further includes a plurality of eject rollers 66 (FIG. 2) and cooperating spring loaded pressure rollers 67 which engage the undersurface of the envelopee as it exists from the nip of the printing die 54 and the impression rollers 56 to ensure that the envelopee is conveyed to the end of the feed deck 18.

Figure 5:
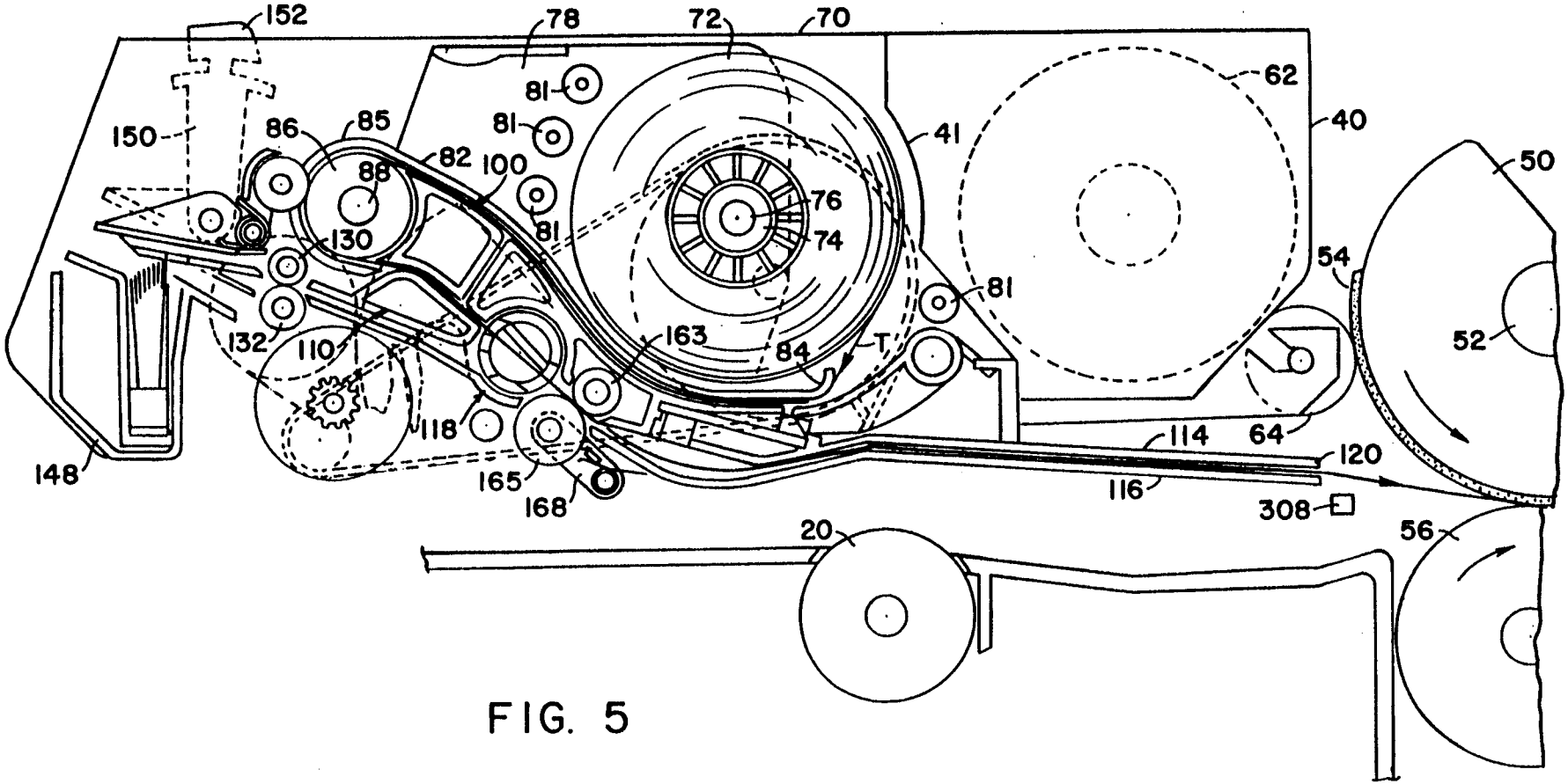
FIG. 5 is a front view of the tape feeding, cutting and ejecting apparatus of the present invention shown in place in the mailing machine, and showing the tape being fed toward and into the postage meter for the printing of the postage indicia thereon.
Figure 6:
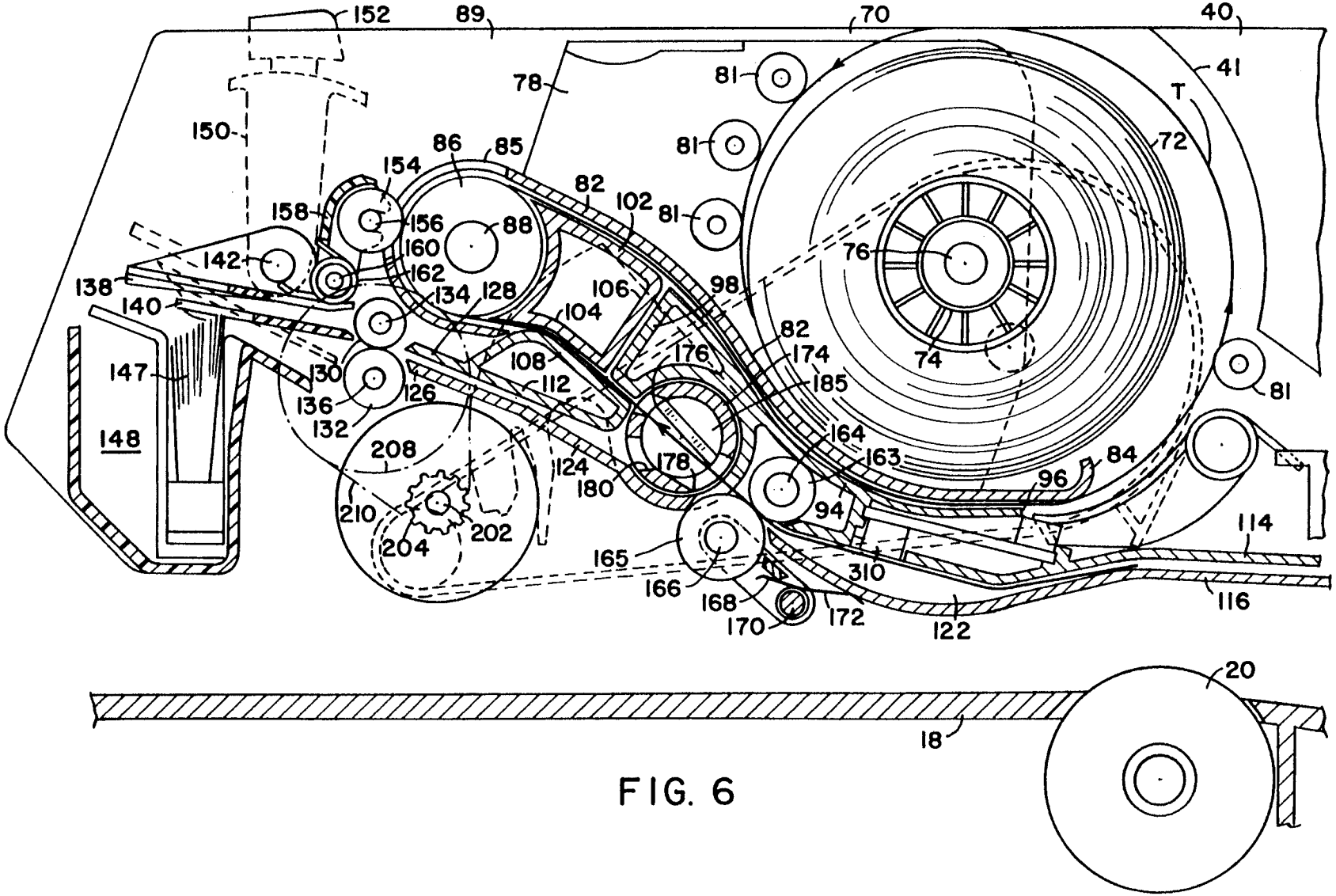
FIG. 6 is a view similar to FIG. 5 but drawn to an enlarged scale and partly in longitudinal section to reveal certain details of construction, and illustrating the tape being fed in the opposite direction to withdraw the printed portion thereof from the postage meter.

Coming now to the essential features of the invention, and referring particularly to FIGS. 2 and 5 through 6, the base 12 includes a generally elongate upstanding wall 70 (FIGS. 1 and 2) which extends along the length of the feed deck 18 and forms a registration wall for envelopes moving along the feed deck. The tape feeding, cutting and ejecting apparatus 16 is mounted on the upstanding wall 70 generally adjacent to the upstream end of the feed deck 18, that is, in advance of the postage meter 14 in terms of the direction of feed of envelopees along the feed deck 18, with the bottom of the apparatus 16 spaced slightly from the feed deck 18 to permit envelopees to pass between it and the feed deck 18. The tape feeding, cutting and ejecting apparatus 16 includes a roll of tape 72 wound on a spindle 74 which is mounted on a stub shaft 76 fixed to an upstanding wall 78 of a mounting frame designated generally by the reference numeral 80 in FIG. 2. The stub shaft 76 is provided with any suitable means for applying some friction to the spindle 74 to prevent the tape roll 72 from overrunning either during feeding of the tape or after feeding has stopped. Also, a plurality of tape guide members 81 are mounted on the mounting frame 80 to assist in forming a loose tape loop during reverse direction feeding of the tape, as more fully described below.

The mounting frame 80 also includes an elongate upper guide plate 82, suitably mounted on or formed integrally with the wall 78, which projects outwardly from the wall 78 and which commences at a point located generally adjacent to the bottom of the roll of tape 72, which is also adjacent to the end of the tape feeding, cutting and ejecting apparatus 16 which is proximate to the postage meter 14, with an upturned lip 84 which forms an entrance guide for a strip of tape T as it comes off the roll 72 and enters a tape channel further described below. The upper guide plate 82 terminates adjacent its opposite end in a U-shaped portion 85 which fits closely around the outer periphery of a drum shaped-tape feed roller 86 fixedly mounted on a shaft 88 which in turn is rotatably mounted between a wall 89 (FIGS. 3, 6 and 12), and another wall 91 (FIG. 12, but not otherwise shown), spaced forwardly from the wall 89 the walls 89 and 91 being the principle structural frame members of the apparatus 16 and between which the other components and parts of the apparatus 16 are mounted. The feed roller 86 preferably has a central portion coated with a suitable high friction material to prevent slippage between the tape T and the feed roller 86 during feeding of the tape.

Still referring to FIGS. 5 and 6, an elongate lower guide plate 94 is suitably secured to or formed integrally with the wall 89 and is disposed contiguously with the upper guide plate 82 over most of its length, commencing with an end 96 located adjacent to the lip 84 on the upper guide plate 82 and extending rearwardly to a downwardly extending wall 98 which is disposed in spaced relationship with the tape feed roll 86 toward the end of the apparatus 16 that is proximate to the postage meter 14.

An upper intermediate guide portion designated generally by the reference numeral 100 in FIG. 5 is suitably mounted on or formed integrally with the wall 78, and disposed in the space between the downwardly extending wall 98 and the tape feed roller 86, and includes an upper guide wall 102, which is disposed in closely spaced relationship with the portion of the upper guide plate 82 which extends beyond the lower guide plate 94, a lower guide wall 104, and an upright wall 106 connected between the upper and lower guide walls 102 and 104. The lower guide wall 104 is disposed in closely spaced relationship with an upper guide wall 108 of a lower intermediate guide portion designated generally by the reference numeral 110 in FIG. 5, and which is also suitably mounted on or formed integrally with the frame wall 89. This intermediate guide portion 110 has a lower guide wall 112, the purpose of which will be made clear hereinbelow.

A second set of elongate upper and lower guide plates 114 and 116 respectively are suitably mounted on or formed integrally with the frame wall 89 and extend generally from a point adjacent to a severing mechanism indicated generally by the reference numeral 118 in FIG. 5 (further described hereinbelow), to another point 120 adjacent the nip of the printing drum 50 of the postage meter 14 and the impression roller 56. The upper and lower guide plates 114 and 116 are disposed in closely spaced relationship over most of their length, except for a relatively short span where they are separated by a substantially larger distance to form a gap 122, the purpose of which will be fully explained hereinbelow.

From the description thus far, it will be seen that the first pair of elongate upper and lower guide plates 82 and 94, the upper guide plate 82 and intermediate upper guide wall 102, the U-shaped portion 85 of the mounting frame 80 and feed roller 86, the intermediate lower and upper guide walls 104 and 108, the severing mechanism 118 and the second pair of elongate upper and lower guide plates 114 and 116 all function together as guide members which constitute a first guide means defining a generally U-shaped first feed path for the tape T which extends generally from beneath the tape supply roll 72 toward the end of the tape feeding, cutting and ejecting apparatus 16 opposite to the end thereof which is proximate to the postage meter 14, and then in the opposite direction toward the end of the apparatus 16 which is proximate to the postage meter, and which terminates closely adjacent to the printing drum 50 and impression roller 56.

Figure 7:
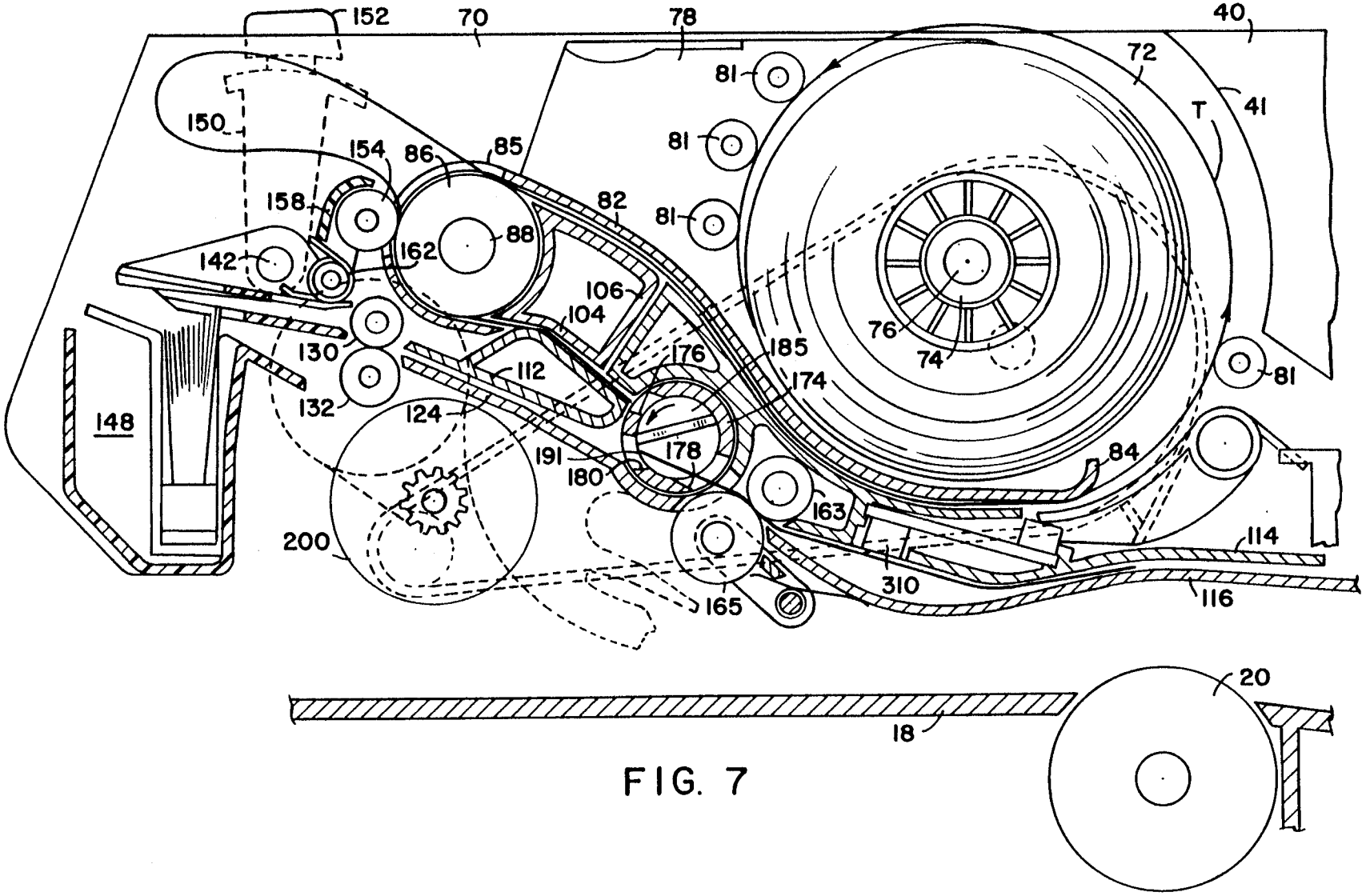
FIG. 7 is a view similar to FIG. 6 but showing the rotary knife in the position in which it has cut the tape and deflected the leading edge of the cut piece of tape from the upper feed path to the lower feed path.
Figure 8:
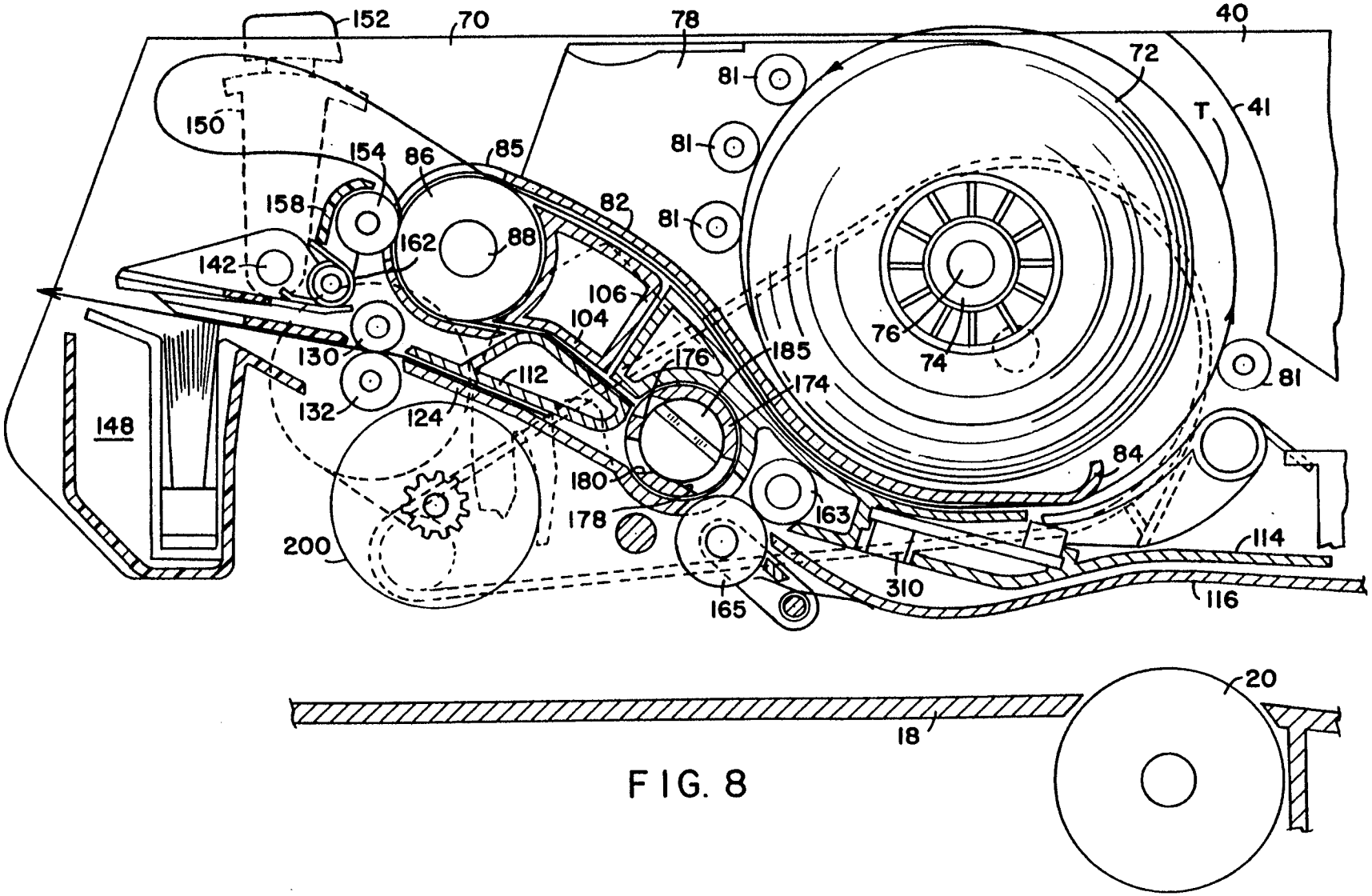
FIG. 8 is a view similar to FIGS. 6 and 7 but showing the severed piece of tape being ejected from the mailing machine and the rotary knife having been returned to its normal position.

Still referring to FIGS. 5 and 6, another generally elongate guide plate 124 is suitably secured to or formed integrally with the frame wall 89 and extends rearwardly from beneath the severing mechanism 118 to an opposite end 126 located generally beneath the feed roller 86. The lower guide wall 112 of the intermediate guide portion 110 also has an end 128 located adjacent to the end 126 of the guide plate 124. The guide plate 124 and the guide wall 112 are closely spaced from one another over that portion of the guide plate 124 which is contiguous with the guide wall 112 to form a narrow channel therebetween for the tape T, as best seen in FIGS. 7 and 9 and further described hereinbelow.

A pair of feed rollers 130 and 132 are mounted on shafts 134 and 136 respectively which are rotatably mounted in the frame wall 89 and front wall 91 (FIG. 13), the feed rollers 130 and 132 being located immediately adjacent to the ends 126 and 128 of the guide plate 124 and guide wall 112 respectively. The operation of these feed rollers will be explained further hereinbelow.

On the opposite side of the feed rollers 130 and 132 is a tape deflector having closely spaced apart upper and lower guide plates 138 and 140 which are suitably connected together to form an integral unit which is fixedly mounted on a shaft 142 pivotally mounted in the frame walls 89 and 91. The deflector plates 138 and 140 lead to an outlet opening 144 (FIG. 1) formed in the side wall 146 of the cover 88. A lever 150 is suitably connected to the shaft 142 and terminates upwardly in a finger button 152 which projects through the top wall 13 (FIG. 1) of the mailing machine housing for access by an operator to oscillate the shaft 142 back and forth to move the deflector plates 138 and 140 between the solid line positions shown in FIGS. 5 and 6 through 8 to the dotted line positions shown in FIG. 5. It will be seen that with the deflector plates 138 and 140 in the solid line positions, a cut piece of tape is directed under the deflector plate 140 and over the top of the bristles 147 of a moistening device 148 so as to moisten the lower surface of the cut piece of tape, if it is gummed tape, for immediate application to an envelopee. With the deflector plates 138 and 140 in the dotted line positions, the cut piece of tape is directed between the deflector plates 138 and 140 to prevent the tape from contacting the moistening bristles 147, and to direct the piece of tape directly to the outlet opening 144.

At this point it should be noted that the lower guide wall 112 and the contiguous portion of the guide plate 124, together with the deflector plates 138 and 140 constitute a second guide means defining a second generally straight feed path which extends from a point on the first feed path away therefrom in a direction generally opposite to that in which the first feed path extends toward the end of the tape feeding, cutting and ejecting apparatus which is proximate to the postage meter.

The tape feeding means of the apparatus 16 will now be described, still with reference to FIGS. 5 and 6, and is seen to comprise the tape feed roller 86 previously described, and an idler roller 154 which is rotatably mounted on a shaft 156 which is fixed in an upstanding frame 158, which in turn is pivotally mounted on another shaft 160 supported by the frame wall 89 and the front wall 91. A suitable coil spring 162 is wrapped around the shaft 160 so that the ends thereof bear against the frame 158 and the upper surface of the deflector plate 138 to urge the frame 158 toward the feed roller 86, thereby pressing the idler roller 154 into firm engagement with the tape T as it passes around the feed roller 86.

Another feed roller 163 is fixedly mounted on a shaft 164 which is rotatably mounted in the frame walls 89 and 91, the feed roller 163 being located just after the severing mechanism 118 in the direction of feed of the tape T toward the postage meter 14. A pair of backup idler rollers 165 are fixedly mounted on a shaft 166 which is rotatably mounted in a frame 168 which in turn is pivotally mounted on another shaft 170 which is mounted on the frame walls 89 and 91. A coil spring 172 is suitably mounted on the shaft 170 so that the ends thereof bear against the underside of the guide plate 116 and the frame 168 to urge the idler roller 165 toward the feed roller 163, thereby providing a firm driving engagement between the feed roller 163 and the tape T.

It should be noted that the feed roller 86 and back idler roller 154, and the feed roller 163 and backup idler roller 165 are all in the first feed path and serve to feed the tape T both toward the postage meter 14 prior to and during the printing of postage indicia on the tape, and away from the postage meter after the printing operation is completed, to bring the printed portion of the tape to the position in which the tape T is severed, as will be further described hereinbelow in connection with the description of the operation of the apparatus 16. The set of feed rollers 130 and 132 are disposed in the second feed path and function to eject the severed piece of tape from the apparatus 16, as previously described. The means by which the feed rollers in both the first and second feed paths are actuated will be described hereinbelow.

The severing mechanism 118 will now be described with particular reference to FIGS. 6, 7, 9, 10, 13 and 14. It should be noted firstly that the severing mechanism 118 is located at the juncture of the above described first and second feed paths, since the severing mechanism 118 also functions as a deflector to deflect the leading edge of the severed portion of tape on which the postage indicia is printed from the first feed path to the second feed path in the manner now to be described.

The severing mechanism 118 comprises an elongate, cylindrical tubular member 174 which is suitably fixedly mounted between the frame walls 89 and 91. The tubular member 174 has a plurality of axially elongate slots formed therein through which the tape T passes, both in its forward and reverse movement. As best seen in FIG. 6, a first slot 176 provides an entrance for the tape T into the tubular member 174, and a second slot 178 disposed on the opposite side of the tubular member 174 from the slot 176 and in diametral alignment with the first feed path provides an exit for the tape T, thus the two slots 176 and 178 permitting the tape T to pass through the tubular member 174 in a straight line. A third slot 180 is formed on the same side of the tubular member 174 as the slot 176, but is disposed slightly beneath the slot 176. The slot 178 provides an exit from the tubular member 174 for the severed portion of the tape T and directs the severed piece of tape into the second feed path, as seen in more detail hereinbelow.

A movable cutting member, designated generally by the numeral 182 in FIG. 10, is rotatably mounted in the tubular member 174 by means of a pair of bearing surfaces 184 which fit into corresponding portions of the tubular member 174 with a very close tolerance so that the cutting member 182 will oscillate smoothly (by means described below) within the tubular member 174. The cutting member 182 has a generally semicylindrical central portion 185 which is also formed to have a close tolerance fit within the tubular member 174. As best seen in FIG. 10, the central portion 185 of the cutting member 182 has a flat surface 186 which is angled slightly from one end of the cutting member 182 to the other, the flat surface 186 defining a sharpened edge 188 which functions as a movable blade to cut the tape T when the cutting member 182 is rotated from the position shown in FIG. 6 to the position shown in FIG. 8, which corresponds to the positions shown in FIGS. 13 and 14, when looking at the severing mechanism from the reverse side. The cutting blade 188 cooperates with the lower edge 190 of the tape entrance slot 176 in the manner of a pair of scissor blades due to the angle of the cutting edge 188 relative to the edge 190 of the slot 176, so as to gradually cut the tape T along a lateral line. It will also be seen by comparing FIGS. 6 and 7 that when the cutting blade 188 moves from the FIG. 6 position to the FIG. 7 position, the cutting blade 188 not only severs the tape but also depresses the leading edge 191 of the cut piece of tape from the fixed cutting edge 190 of the upper slot 176 to the lower slot 180 so that further movement of the severed portion of the tape in the reverse direction will be directed along the second feed path between the guide plate 124 and the lower guide wall 112.

From the foregoing description, it should be apparent that the tubular member 174 and the cutting member 182 constitute a severing means disposed in the first feed path for severing the tape at a predetermined location and for deflecting the leading edge of the severed portion of tape from the tape entrance slot 176 where the tape is cut to the tape exit slot 180 to be ejected from the mailing machine 10 along the second feed path as previously described.

Figure 12:
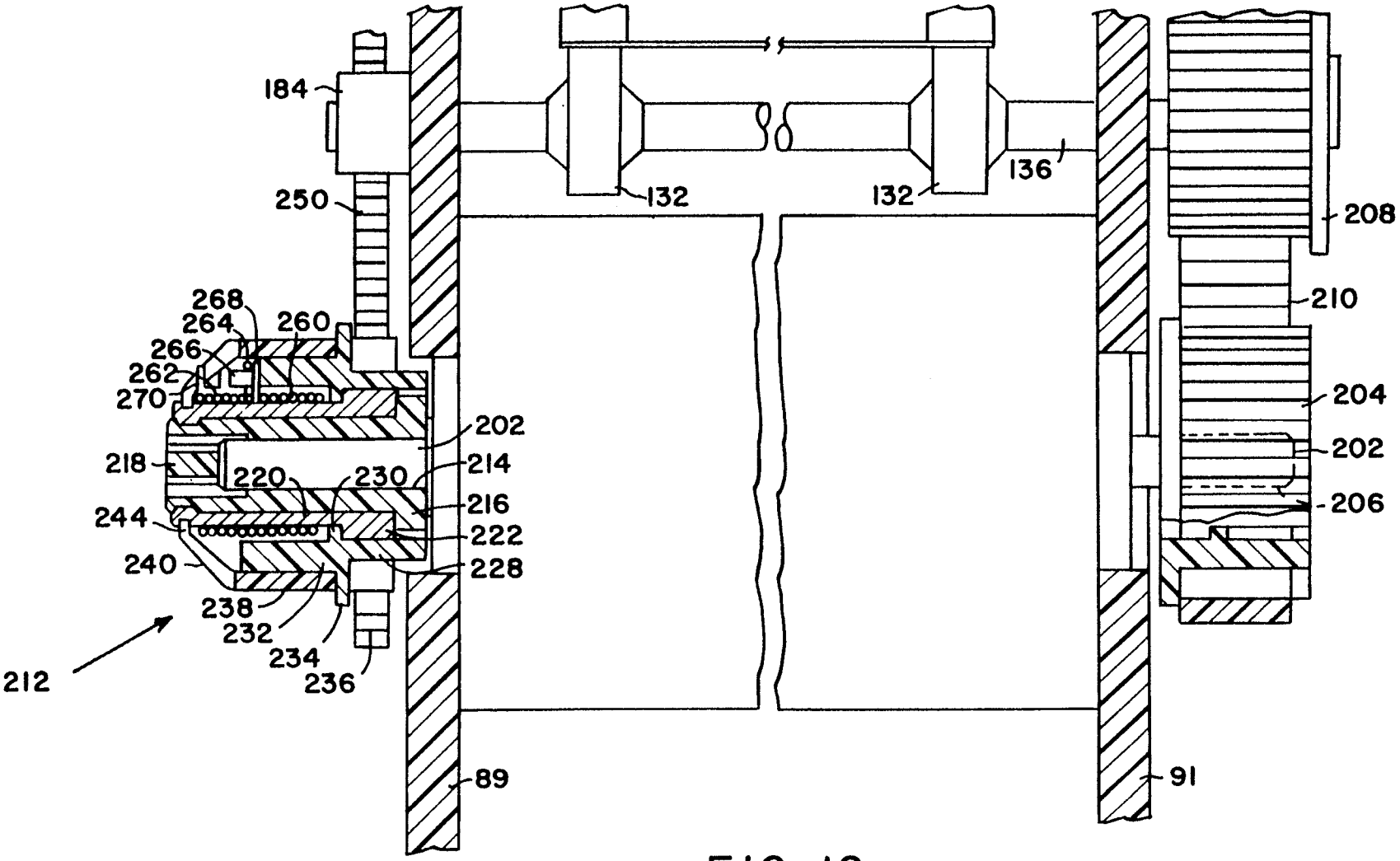
FIG. 12 is a sectional view taken on the line 12—12 of FIG. 11 and showing details of the clutching mechanism which controls the movement of the rotary knife.

The severing mechanism 118 just described and the tape ejection feed rollers 130 and 132 are operated in a predetermined synchronous relationship to first sever the printed portion of the tape from the tape strip and then eject the severed portion from the mailing machine, which is accomplished by a reversible drive mechanism now to be described with reference to FIGS. 6, 9 and 12 through 17. Referring first to FIGS. 9 and 12, it will be seen that a reversible electric motor 200 is suitably mounted between the frame walls 89 and 91 in a location beneath the guide plate 124 and generally in vertical alignment with the tape feed roller 86. The motor 200 has a drive shaft 202 which extends outwardly from both ends of the motor, and end projecting beyond the wall 89 operating the tape severing mechanism 118 and the end projecting beyond the wall 91 operating the feed rollers 132, both in the manner now to be described.

Looking at the latter end first, it will be seen that a timing gear 204 is rotatably mounted on the shaft 202, with a suitable one-way friction clutch 206 interposed between the shaft 202 and the gear 204 so that the shaft 202 is in driving engagement with the gear 204 only when the shaft 202 is rotating in a counter clockwise direction when viewed from the front as in FIG. 6. Another timing gear 208 is fixedly mounted on the shaft 136 which carries the tape feed rollers 132. A timing belt 210 extends around both gears 204 and 208 to drive the gear 208, shaft 136 and tape feed rollers 132 in a counter clockwise direction as viewed in FIG. 6 when the motor 200 is energized to rotate the shaft 202 in the same direction, thereby feeding a severed piece of tape along the second feed path toward the exist 142 from the mailing machine 10. When the motor 200 is reversed to drive the shaft 202 in a clockwise direction as viewed in FIG. 6, the one way clutch 206 prevents the gear 204 from being driven in that direction which in turn prevents the feed rollers 130 from rotating in the same direction, thereby preventing the feed rollers 130 and 132 from pulling a cut piece of tape back into the apparatus during the next cycle of operation which may not have been fully ejected during the previous cycle of operation.

Figure 13:
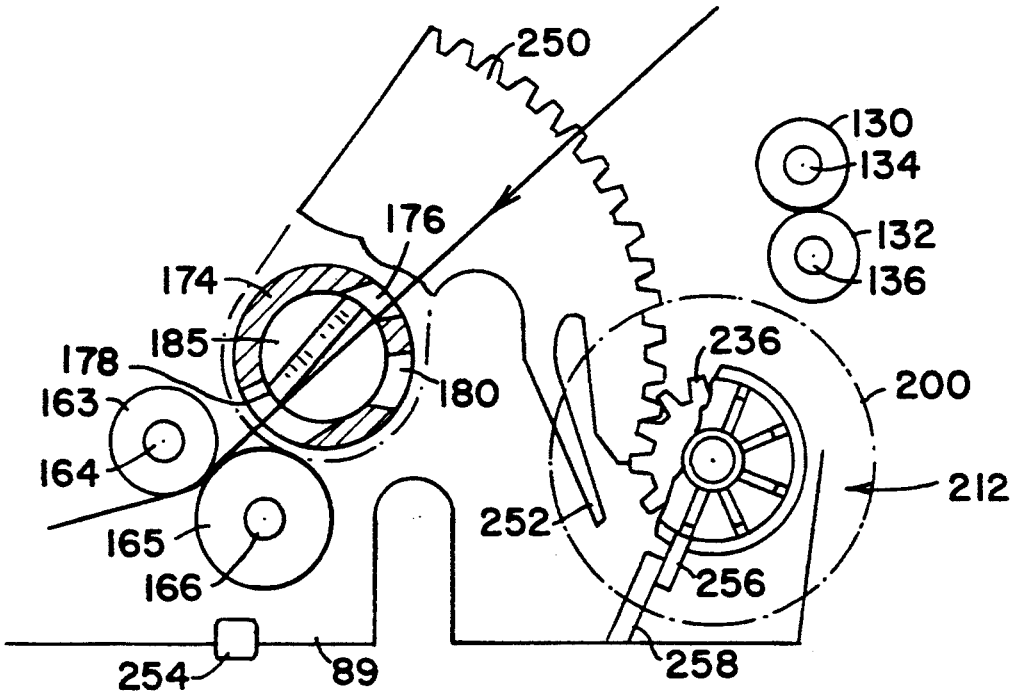
FIG. 13 is a fragmentary side view of the clutching mechanism that controls the movement of the rotary knife, showing the parts in the position they occupy when the knife is in its normal position.

The end of the motor shaft 202 which projects through the wall 89 is connected to a clutching device designated generally by the reference numeral 212 in FIGS. 10 and 13 and functions to control the oscillatory movement of the movable knife element 185 of the severing mechanism 118. With particular reference to FIGS. 10 and 13 through 18, it will be seen that a tubular mounting member 214 fits over the shaft 202 with a sufficiently tight press fit to be in driving engagement therewith, the tubular mounting member 214 having a radially outwardly projecting flange 216 at its inner end and a plurality of separate fingers 218 formed at its outer end. A tubular clutch hub 220 fits over the mounting member 214 also with a sufficiently tight press fit to be in driving engagement therewith, the clutch hub 220 also having a radially outwardly projecting flange 222 which abuts against the flange 216 on the mounting member 214, as best seen in FIG. 13. The clutch hub 220 is locked onto the mounting member 214 by means of an annular rib 223 which snaps into annular grooves 224 formed adjacent the outer ends of the fingers 218.

A tubular clutch housing, designated generally by the reference numeral 226 has a first tubular portion 228 which fits over the clutch hub 220 until the inner surface of an internal radially inwardly projecting flange 230 abuts the outer surface of the flange 222 on the clutch hub 220. A second tubular portion 232 projects axially outwardly from the first tubular portion 228, and a radially outwardly projecting flange 234 is formed on the clutch housing 226 between the first and second tubular portions 228 and 232. Adjacent the inner surface of the flange 234 is a gear 236 which is preferably formed integrally with the clutch housing 226. The clutch housing 226 is held onto the clutch hub 220 by means of an end cap 238, the inner end of which abuts against the flange 234. The end cap 238 has a plurality of fingers 240 formed on the axial outer end thereof which define slots 242 therebetween, and each of the fingers 240 terminates in a radially inturned lip 244 which fits into an annular groove 246 on the outer end of the clutch hub 220.

Figure 14:
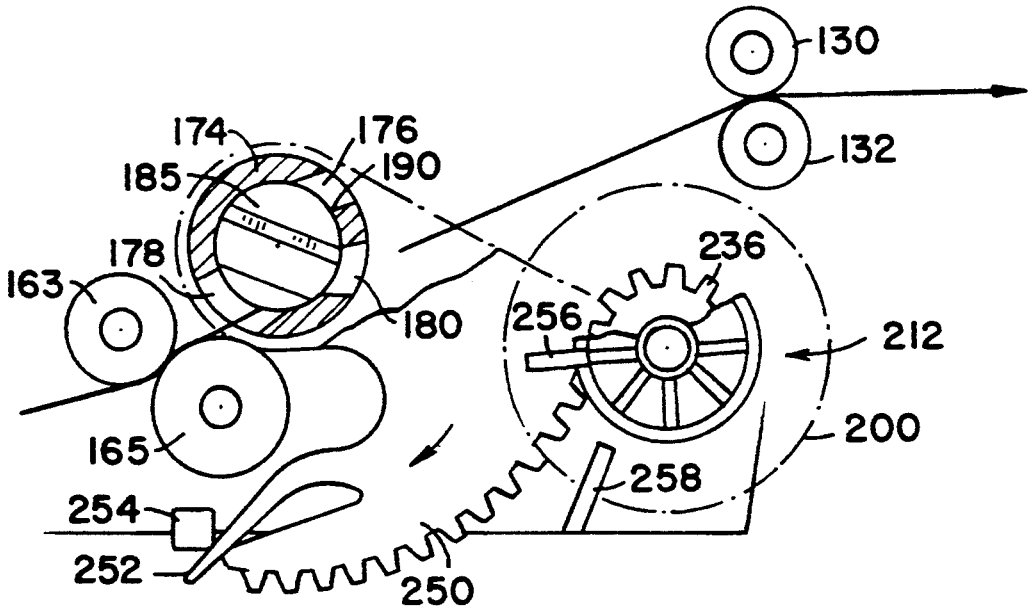
FIG. 14 is a view similar to FIG. 13 but showing the parts in the position they occupy when the knife is in the cut and deflect position.

As best seen in FIGS. 9, 13 and 14, the gear 236 on the clutch housing 226 meshes with a gear segment 250 which is fixedly connected to the bearing portion 184 of the rotary cutting member 182 which extends through the wall 89, so that arcuate movement of the gear segment 250 in either direction causes corresponding arcuate movement of the cutting member 182 within the tubular member 174 in the same direction. The gear segment 250 is provided with a tail 252 which abuts a stop member 254 formed on the wall 89 to limit the extent of movement of the gear segment 250 in one direction, as best seen in FIG. 14. Movement of the gear segment 250 in the opposite direction is limited by providing a tab 256 on the end cap 238 which abuts another stop member 258 also formed on the wall 89, as best seen in FIG. 13.

Referring now particularly to FIGS. 12 and 15 through 17, in order to move the gear segment 250 and the cutting member 182 sequentially in opposite directions, a pair of wrap spring clutches 260 and 262 are mounted on and normally wrapped tightly around the clutch hub 220 so as to be in driving engagement therewith. The wrap spring clutch 260 is a non-releasable one-way clutch that functions to connect the motor shaft 202 to the clutch housing 226 when the shaft 202 rotates in one direction to drive the clutch housing 226 and associated gear 236 in one direction to cause the gear segment 250 and the cutting member 182 to rotate in the appropriate direction to cause the cutting member 182 to cut the tape and to deflect the leading edge of the cut segment from the upper slot 176 in the tubular member 174 to the lower slot 180. The other clutch 262 is a releasable one-way clutch that functions to connect the motor shaft 202 to the clutch housing 226 when the shaft 202 rotates in the opposite direction to drive the clutch housing 226 and associated gear 236 in the opposite direction to cause the gear segment 250 and the cutting member 182 to rotate in the opposite direction so as to return the cutting member 182 to its original position.

Thus, it will be seen that the wrap spring clutch 260 has a loop shaped tang formed on the end coil of the spring remote from the motor 200 and which is connected to a pin 266 which projects axially outwardly from the outer face of the second tubular portion 232 of the clutch housing 226 when the wrap spring clutch 260 is disposed on the clutch hub 220 within the inner tubular portion 228, as best seen in FIG. 12. Since the wrap spring clutch 260 has a tang on only one end, the gripping force it exerts on the clutch hub 220 cannot be released, although the clutch hub 220 is locked for rotation with the wrap spring clutch 260 in one direction of rotation.

The wrap spring clutch 262 has a loop shaped tang formed on the end coil of the spring closest to the motor 200 and which is connected to the pin 266 when this spring is disposed on the clutch hub 220 within the outer tubular portion of the clutch housing 226, again as best seen in FIG. 12. However, the wrap spring clutch 262 also has a straight tang 270 formed on the opposite end of the spring from tang 268, this tang 270 being engaged in one of the slots 242 of the end cap 238. Thus, by forcing the loop shaped tang 268 and the straight tang 270 in opposite directions away from one another in the manner described below, the diameter of the spring coils are expanded slightly and the spring 262 completely releases its grip on the clutch hub 220, thereby allowing the clutch spring 262 and the clutch hub 220 to rotate freely with respect to one another in either direction. The manner in which this mechanism operates to oscillate the cutting member 182 will be further explained hereinbelow in connection with the description of a complete cycle of operation of the apparatus 16.

Figure 3:
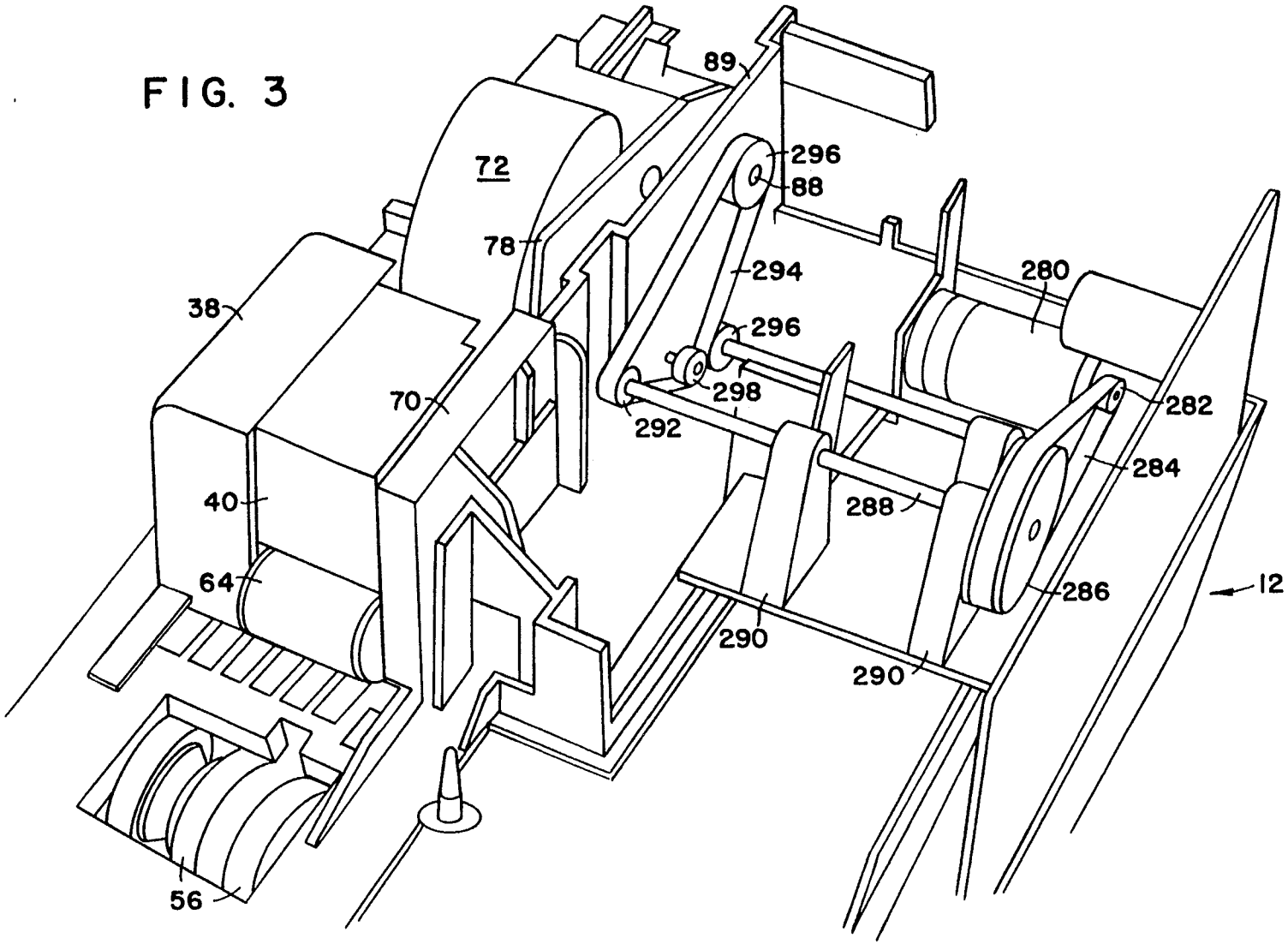
FIG. 3 is a partial rear perspective view of the mailing machine with the outer housing removed to show details of the tape feeding mechanism.
Figure 4:
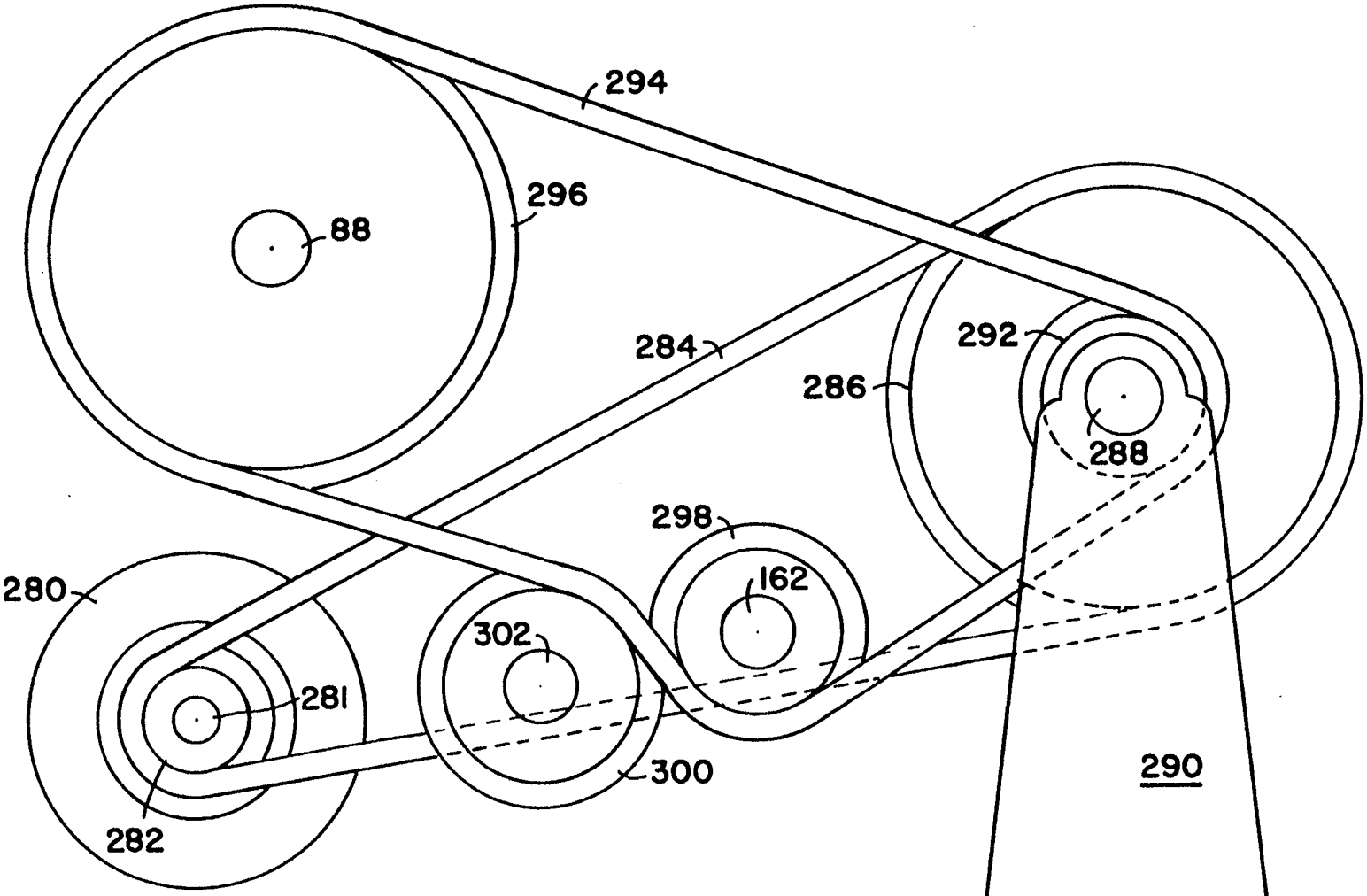
FIG. 4 is a fragmentary view of a portion of the drive mechanism shown in FIG. 3.

The main drive mechanism for the tape feeding means along the first feed path will now me described with reference to FIGS. 3, 4, 6 and 7. As best seen in FIGS. 3 and 4, the base 12 of the mailing machine 10 suitably supports a motor 280 having a drive shaft 281 on which a timing pulley 282 is fixedly mounted. A timing belt 284 passes around the pulley 282 so as to be driven thereby, and also passes around another timing pulley 286 which is fixedly mounted on a shaft 288 rotatably supported by a pair of upstanding bearing plates 290 also suitably mounted on the base 12. The pulley 286 is of substantially larger diameter than the pulley 282 mounted on the motor shaft so as to effect a substantial speed reduction between the small pulley 282 and the large pulley 286.

Another small pulley 213 is fixedly mounted on the other end of the shaft 288, and another timing belt 294 passes around the pulley 213 so as to be driven thereby, and also around a pulley 296 fixedly mounted on the shaft 88 to thereby rotate the shaft 88 and the tape feed roller 86 mounted thereon. It will be seen that the pulley 296 is also of substantially larger diameter than the pulley 213, thereby achieving a further speed reduction between the pulley 282 on the motor shaft 281 and the pulley 296 which drives the tape feed roller 86.

The belt 294 also passes part way around a pulley 298 which is fixedly mounted on the shaft 162 which carries the tape feed roller 160, and also passes part way around a pulley 300 which is mounted on a shaft 302 suitably supported on the mailing machine base 12. The pulley 300 is merely an idler to maintain proper driving tension on the belt 294.

From the description thus far, it will be seen that rotation of the motor 280 in either direction, as controlled in a manner hereinafter described, causes the tape feed rollers 86 and 160 to rotate in the appropriate direction to feed the tape T along the first feed path toward the printing mechanism of the postage meter 14 for printing of the postage indicia thereon, and thereafter in the reverse direction to bring the printed portion of the tape to the position in which it is severed from the rest of the tape by the severing mechanism 118.

A complete cycle of operation of the tape cutting, feeding and ejecting apparatus 16 will now be described. The cycle of operation is initiated by the operator pressing a suitable "start" button 304 (FIGS. 1 and 2) located in a control panel 306 on the mailing machine 10, in which there are other buttons for controlling various operations of the mailing machine not pertinent to this invention. The mailing machine 10 also includes a microprocessor which controls the sequence of operation of other components of the mailing machine, including those in the base 12 and the postage meter 14, as well as in the tape feeding, cutting and ejecting apparatus 16. The details of the microprocessor are not described or shown since they form no part of the present invention, and it is well known to those skilled in the art to use a microprocessor to control the sequence of operation of any number and type of components of a machine.

Thus, when it is desired to print postage indicia on the tape T, pressing the "start" button 304 causes the microprocessor to energize the motor 280 to rotate in a clockwise direction as viewed in FIG. 3, thereby rotating the pulley 282 in the same direction to drive the belt 284, pulley 286, shaft 288, pulley 213, belt 294, pulley 296 and shaft 88 and finally feed roller 86 in the same direction. Thus, the feed roller 86 is rotated in a counter clockwise direction as viewed in FIGS. 5 and 6 to feed the tape T through the first feed path from the tape roll 72 to the postage meter 14. At this time, the cutting member 182 is in the position shown in FIGS. 5 and 6 so that the tape T passes through the severing mechanism 118 in a straight line. The feed roller 163 is driven in a counter clockwise direction by the belt 294 as it passes under the pulley 298 mounted on the same shaft 164 as the feed roller 163. When the leading edge of the tape T reaches the nip of the feed roller 163 and the backup idler roller 165, these rollers continue to feed the tape toward the postage meter until the leading edge of the tape T passes a suitable trip sensor 308 (FIG. 5, the details of which form no part of the present invention) suitably mounted on the base 12, which detects the arrival of the leading edge of the tape and causes the microprocessor to energize the postage meter motor which drives the printing drum 50 to commence rotation of the drum 50. The timing is such that the leading edge of the printing die 54 and the leading edge of the tape T arrive at the nip of the printing die 54 and the impression roller 56 at the same time, as seen in FIG. 5, after which printing of the postage indicia on the tape T commences. The microprocessor includes a suitable tape length measuring device, such as a pulse counter or optical tachometer, which measures the amount of tape that is fed by the feed rollers 86 and 163 from the starting point of the tape T adjacent to the severing mechanism to and through the postage meter 14 until completion of the printing operation, this length of tape being defined for convenience of terminology as a finite length of tape.

As the leading edge of the tape T passes through the wide space 122 between the lower surface of the upper guide plate 114 and the upper surface of the lower guide pate 116, the tape lies contiguous with the upper surface of the guide plate 116 until the leading edge is picked by the nip of the printing die 54 and the impression roller 56. The printing die 54 and impression roller 56 rotate at a slightly higher speed than the feed rollers 86 and 163, which results in the tape T being pulled upwardly in the space 122 so as to lie contiguous to the lower surface of the upper guide plate 114, which movement is sensed by a suitable proximity sensor 310 suitably mounted in the apparatus 16 above the upper guide plate 114, as best seen in FIG. 6. When the printing operation is complete, the printing die 54 continues to rotate and the tape T is no longer gripped between the printing die 54 and the impression roller 56, which allows the tape in the space 122 to go slack and move downwardly to the upper surface of the lower guide plate 116. This movement is again sensed by the proximity sensor 310, which now causes the microprocessor to reverse the direction of rotation of tape feed motor 280, thereby reversing the direction of movement of all of the parts mentioned above which are driven by the motor 280 so as to reverse the direction of movement of the tape T in the first feed path and withdraw the portion of the tape T on which the postage indicia is printed from the postage meter 14.

When the tape length measuring device of the microprocessor has determined that a sufficient length of tape T has been fed in the reverse direction to bring the printed portion of the finite length of tape to the severing mechanism 118, particularly to the fixed blade edge 190, the tape length measuring device causes the microprocessor to deenergize the motor 280 to stop the feeding of the tape T. It also simultaneously energizes the motor 200 to rotate the shaft 202 in a clockwise direction as viewed in FIGS. 5 and 7 or counter clockwise as viewed in FIG. 13, to cause the gear segment 250 to rotate in the opposite direction as viewed in the same figures to thereby rotate the cutting member 182 from the position shown in FIG. 5 to that shown in FIG. 6 to sever the printed portion of the tape T and to deflect the new leading edge 191 of the cut piece of tape from the upper slot 176 to the lower slot 180 of the tubular member 174.

The movement of the cutting member 182 occurs through the clutching device 212 in the manner now to be described. When the motor 200 is energized to rotate the motor shaft 202 as just mentioned, the motor shaft 202, mounting member 214 and clutch hub 220 all rotate as a unit. Since the wrap spring clutch 260 is wrapped tightly around the clutch hub 220, it also rotates with the clutch hub 220 and causes the tubular clutch housing 226 to rotate due to the engagement of the loop tang 264 on the wrap spring clutch 260 with the pin 266 on the clutch housing 220. The gear 236 also rotates with the clutch housing 226 to rotate the gear segment 250 in the direction opposite to that of the gear 236, which in turn rotates the cutting member 182 in a clockwise direction as viewed in FIG. 13. The gear segment 250 and the cutting member 182 continue to rotate until the tail 252 on the gear segment 250 abuts the stop member 254 on the frame wall 89, at which time the motor 200 simply stalls, even though it remains energized by the microprocessor. At this point, the new leading edge 191 (FIGS. 8 and 14) has been deflected from the fixed cutting blade 190 of the upper slot 174 to the lower slot 180 and is in position to be directed out of the slot 180 toward the eject rollers 130 and 132. During this operation, the wrap spring clutch 262 has had no effect on the clutch hub 220 because, being a one-way clutch, it slips in this direction of movement and drives only in the opposite direction of movement.

As soon as the cutting operation has been completed, the microprocessor maintains the motor 200 energized to hold the cutting member 182 in the position shown in FIG. 14, and simultaneously restarts the motor 280 in the same reverse direction in which it was operating just prior to the cutting operation, so that the feed roller 163 and backup roller 165 will now push the cut piece of tape through the lower slot 180 and into the second feed path as defined by the lower guide wall 112 and the lower guide plate 124, until the leading edge 191 of the cut piece of tape is picked up in the nip of the feed rollers 130 and 132. This will occur before the trailing edge of the cut piece of tape exists from the nip of the feed roller 163 and backup roller 165 because the length of the cut piece of tape is greater than the distance between the feed roller 163 in the first feed path and the feed rollers 130 and 132 in the second feed path. Also, during the time that the feed roller 163 and backup roller 165 having been feeding the cut piece of tape into the second feed path, the feed roller 86 has been feeding the main strip of tape T in a reverse direction to withdraw the new leading edge thereof to a normal storage position adjacent to the bottom of the feed roller 86. As the tape is fed in the reverse direction by the feed roller 86, the upper and lower guide plates 82 and 94, as well as the upper guide wall 102, force the tape to follow the first feed path back to the tape roll 72, and cause it to form a loose coil T' (FIGS. 6, 7 and 8) around the tape roll 72, the loop formation being assisted by the tape loop guide members 81, the curved wall 41 of the ink cartridge holder 40, and the underside of the cover 15 of the housing 13 when the cover is in its closed position, thereby eliminating the necessity for any additional complex mechanism to drive the tape roll in a reverse or winding direction to take up the slack.

When the main strip of tape T reaches this position, the microprocessor deenergizes the motor 280 to stop rotation of the feed rollers 86 and 163, and simultaneously reverses the direction of operation of the motor 200. Thus, the motor shaft 202, the mounting member 214 and the clutch hub 220 now rotate in the opposite direction, with the result that the wrap spring clutch 260 slips with respect to the clutch hub 220 and the wrap spring clutch 262 grips the clutch hub 220 to rotate the tubular clutch housing 226 in the opposite direction due to the engagement of the loop tang 268 on the wrap spring clutch 262 with the pin 266 on the clutch housing 226. Rotation of the clutch housing 226 causes the gear 236 to rotate in the same direction which in turn rotates the gear segment 250 in the opposite direction to rotate the cutting member in a counter clockwise direction as viewed in FIGS. 14 and 15 so as to return the cutting member 182 to its original position.

At this point, however, the cut piece of tape is still in the nip of the eject feed rollers 130 and 132, so the motor 200 must remain energized until the trailing edge of the cut piece of tape has passed the rollers 130 and 132. This is accomplished by making the wrap spring clutch 262 releasable, so that the motor 200 can continue to operate even though the cutting member 182 has been returned to its original position. Thus, when the gear segment 250 and gear 236 have returned the cutting member 182 to its original position, the end cap 238, which rotates with the clutch housing 226 has moved to a position where the tab 256 abuts the stop member 258 on the wall 89, which causes the slot 242 to push the tang 270 of the wrap spring clutch 262 away arcuately away from the loop tang 268, thereby causing the coils of the wrap spring clutch 262 to expand and release their grip on the clutch hub 220, thereby allowing the motor 200 to continue to operate without jamming the clutch mechanism 212 or stalling the motor.

The motor 200 continues to operate to drive the pulley 204, the belt 210, the pulley 206, the shafts 134 and 136 and the feed rollers 130 and 132 until a portion of the cut piece of tape has been fed through the exit opening 144 for removal from the mailing machine by the operator, at which time the microprocessor deenergizes the motor 200 and the cycle of operation is complete.

It should be remembered that the microprocessor deenergized the motor 280 while the cut piece of tape was both in the nip of the eject feed rollers 130 and 132 and still in the nip of the feed roller 163 and the backup idler roller 165 In order to allow the cut piece of tape to be fed through the second feed path while a portion of it is still in the first feed path, the grip of the eject feed rollers 130 and 132 is made considerably stronger than the grip of the feed roller 163 and the backup roller 165, so that the feed rollers 130 and 132 simply pull the tape through the nip of the roller 163 and backup roller 165 without the tape tearing.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. In a mailing machine having an elongate feed deck, means for feeding envelopes along the feed deck, and a postage meter mounted in the mailing machine and having a printing mechanism disposed in juxtaposition with the feed deck so as to print postage indicia on successive envelopes as they are fed along the feed deck, a tape feeding, cutting and ejecting apparatus mounted in the mailing machine above the feed deck and adjacent to the postage meter on the upstream side thereof with respect to the direction of feed of envelopes along the feed deck for feeding successive finite lengths of tape to the postage meter for printing of postage indicia on a portion thereof and for cutting and ejecting the printed portion of the finite lengths of tape from the mailing machine, said apparatus comprising:

A. means for holding a supply roll of tape of indefinite length adjacent the end of said apparatus proximate to the postage meter of the mailing machine, B. first guide means defining a generally U-shaped first feed path which extends generally from beneath said tape supply roll toward the end of said apparatus opposite to said end thereof proximate to the postage meter and which then extends in an opposite direction toward said end proximate to the postage meter, said first feed path terminating closely adjacent to the printing mechanism of the postage meter, C. second guide means defining a generally straight second feed path which extends from a location on said first feed path away therefrom in a direction generally opposite to that in which said first feed path extends toward said end of said apparatus proximate the postage meter;

D. tape feeding means for feeding a finite length of tape from said tape supply roll in a forward direction along said first feed path to feed a portion of said finite length of tape through the printing mechanism of the postage meter for printing of a postage indicia on said portion of said finite length of tape, E. means for reversing the direction of said tape feeding means to feed said tape in a reverse direction along said first feed path, F. severing means disposed at the juncture of said first feed path and said second feed path for severing said tape when a trailing edge of the printed portion of said finite length of tape reaches said severing means and for deflecting a leading edge of the severed portion of said tape into said second feed path, and G. means for ejecting said severed printed portion of tape from the mailing machine along said second feed path, whereby said first and second guide means and said tape storing, feeding, severing and ejecting means are all positioned entirely on one side of the postage meter.

2. An apparatus as set forth in claim 1 wherein said first guide means comprises:

A. a first pair of elongate narrowly spaced apart guide members which define a first portion of said first feed path extending from beneath said tape roll toward said end of said apparatus opposite to said end that is proximate to said postage meter, and B. a first pair of narrowly spaced apart intermediate guide members which together define a second portion of said first feed path which extends in opposition to said first portion toward said end of said apparatus that is proximate to the postage meter, whereby said first pair of elongate guide members and said first pair of intermediate guide members and a second pair of elongate guide members define the U-shaped configuration for said first feed path.

3. An apparatus as set forth in claim 2 wherein said second guide means comprises:

A. a second pair of narrowly spaced apart intermediate guide member disposed in juxtaposition with said first pair of intermediate guide members and extending in the same general direction as said first pair of intermediate guide members, but at a slight divergent angle with respect thereto, and B. a third pair of narrowly spaced elongate guide members which define an outlet channel from said apparatus and the mailing machine for severed pieces of tape.

4. An apparatus as set forth in claim 3 wherein said tape feeding means comprises:

A. a first feed roller disposed in said first feed path between said first pair of elongate guide members and said first pair of intermediate guide members, said first feed roller defining a reverse curve in said first feed path, and B. a second feed roller disposed in said first feed path between said first pair of intermediate guide members and said second pair of elongate guide members.

5. An apparatus as set forth in claim 4 wherein said severing means is disposed between said first pair of intermediate guide members and said second pair of elongate guide members in advance of said second feed roller.

6. An apparatus as set forth in claim 5 wherein said ejecting means comprises a pair of feed rollers disposed adjacent outer ends of said second pair of intermediate guide members and between said second pair of intermediate guide members and said third pair of elongate guide members.

7. An apparatus as set forth in claim 6 wherein the mailing machine further includes a pivotally mounted cover for providing access to said tape feeding, cutting and ejecting apparatus and an ink cartridge holder mounted adjacent to said tape supply roll and having a curved surface disposed adjacent to said tape roll and having a curved surface disposed adjacent to the periphery of said tape supply roll, and further including means for causing the tape to form a relatively loose loop extending at least partly around said tape supply roll when said tape feeding means is feeding said tape in a reverse direction toward said tape supply roll.

8. An apparatus as set forth in claim 7 wherein said means for forming said loose tape loop comprises a plurality of tape guide members disposed in arcuately spaced relationship around said tape supply roll, said tape guide members functioning, with the assistance of the underside of said cover and said curved surface on said ink cartridge holder to confine the tape to a loose loop formation around said tape supply roll.

9. An apparatus as set forth in claim 1 wherein said severing means comprises:

A. an elongate hollow tubular member extending laterally across the path of said tape, said tubular member having first and second axially elongate slots formed therein in diametral alignment with said first feed path, whereby said tape passes through said tubular member during forward and reverse movement of said tape, said tubular member having a third axially elongate slot formed therein adjacent to but spaced slightly beneath said first slot, and B. a cutting member rotatably mounted within said tubular member for cutting said tape and for deflecting the end of the cut portion of said tape from said first slot to said third slot.

10. An apparatus as set forth in claim 9 wherein

A. the lower edge of said first slot defines a fixed cutting blade,

B. said cutting member has a flat surface formed thereon which extends axially along said cutting member at a slight angle to the longitudinal axis of said cutting member, and C. a lead edge of said flat surface in the cutting direction of rotation of said cutting member constitutes a movable blade to cut said tape laterally across the width thereof during arcuate movement of said cutting member.

11. An apparatus as set forth in claim 10 further including a single reversible driving means for operating both said severing means and said ejecting means in a predetermined synchronous relationship to first sever said printed portion of said tape and then eject the severed portion from the mailing machine.

12. An apparatus as set forth in claim 11 wherein said driving means includes

A. means for sequentially driving said cutting member in opposite directions to rotate said cutting member first in a cutting direction from a normal position to a cut and deflect position and then in a reverse direction to return said cutting member to said normal position, and B. means operable when said cutting member is moving in said reverse direction for driving said ejecting feed rollers in a single direction to move said severed portion of tape along said second feed path.

13. An apparatus as set forth in claim 12 wherein said means for sequentially driving said cutting member in opposite directions comprises:

A. a reversible electric motor capable of selectively operating in first and second directions, said motor having a drive shaft that projects outwardly from opposite ends of said motor, B. first means for connecting said cutting member to one end of said drive shaft for operating said cutting member when said drive shaft rotates in both said first and second directions, and C. second means for connecting said ejecting feed rollers to the opposite end of said drive shaft for preventing said drive shaft from driving said ejecting feed rollers during rotation of said drive shaft in said first direction, but causes said drive shaft to drive said ejecting feed rollers during rotation of said drive shaft in said second direction.

14. An apparatus as set forth in claim 13 wherein said first means comprises a clutch mechanism interposed between said drive shaft and said cutting mechanism, said clutch mechanism having:

A. a clutch hub mounted on said motor shaft for rotation therewith,

B. a first one way clutch element for connecting said cutting member to said clutch hub during rotation of said drive shaft in said first direction, and C. a second one way clutch element for connecting said cutting member to said clutch hub during rotation of said drive shaft in said second direction.

15. An apparatus as set forth in claim 14 wherein said clutch elements comprise a pair of wrap spring clutches which are wound around said clutch hub in a direction to normally grip said clutch hub in driving relationship, said wrap spring clutches having at least one end tang which loosens the grip of said wrap spring clutch on said clutch hub when said tang is moved in a direction opposite to the direction of normal bias of said wrap spring clutches, whereby both of said wrap spring clutches are one way drive.

16. An apparatus as set forth in claim 15 wherein said second means includes a one way clutch interposed between said drive shaft and said ejecting feed rollers.

* * * * *